US005435476A

United States Patent [19]

Simpson

[11] Patent Number: 5,435,476

[45] Date of Patent: Jul. 25, 1995

[54] VEHICLE FOR FABRICATING FRAMES FOR BUILDINGS

[76] Inventor: Glenn A. Simpson, 8382 Blue Lake Dr., San Diego, Calif. 92119

[21] Appl. No.: 201,427

[22] Filed: Feb. 24, 1994

[51] Int. Cl.[6] ..... B27F 7/02

[52] U.S. Cl. ..... 227/2; 227/39; 227/101; 227/153; 29/701; 29/822

[58] Field of Search ..... 227/2, 3, 40, 47, 99, 227/100, 101, 152, 153, 39; 269/321 F; 29/822, 701

[56] References Cited

U.S. PATENT DOCUMENTS

| | | | |
|---|---|---|---|
| 3,591,067 | 7/1971 | Vial | 227/100 |
| 3,628,714 | 12/1971 | Offenwanger | 227/100 |
| 3,765,587 | 10/1973 | Davis | 227/100 |
| 3,822,815 | 7/1974 | Davis | 227/100 |
| 4,039,112 | 8/1977 | Bethel F. Schultz | 6/1/76 |
| 4,133,097 | 1/1979 | Slade (deceased) | 7/5/77 |
| 3,228,580 | 1/1966 | C.D. Washington, et al | 6/27/63 |
| 3,592,376 | 7/1971 | Walter George Moehlenpak | 1/8/70 |
| 3,711,007 | 1/1973 | Arnold H. Fry | 11/12/70 |
| 4,395,538 | 12/1981 | Schultz (deceased), et al | 11/2/79 |

*Primary Examiner*—Scott A. Smith

[57] ABSTRACT

An apparatus to assemble prefabricated walls and joist panels for homes, apartments, commercial buildings, etc. Apparatus is self-loading and can place and fasten 2×3, 2×4, 3×4, 4×4, and 4×6 cross members between parallel plates on the fly, having telescoping carriage and track, cross members may vary in length from 7-½ feet to 12 feet. Self-contained and portable apparatus may be used in remote locations and transported without special highway permits. All the frames for a building can be fabricated in on production run therefore saving handling and storage.

1 Claim, 8 Drawing Sheets

VEHICLE FOR FABRICATING FRAMES FOR BUILDINGS

BACKGROUND OF THE INVENTION

1. Field of the Invention

The principal object of the invention is to provide a more efficient method of prefabricating wall and joist frames for buildings. All the construction materials are contained in a wheeled self-loading carrier rolling on a prepared track. The carriage being driven by hydraulic motors.

2. Description of the Related Art

The Schulz apparatus U.S. Pat. No. 4,039,112 is not portable, self-contained or self-loading. The Slade apparatus U.S. Pat. No. 4,133,097 has no automatic material handling and is not self-contained. The Washington U.S. Pat. No. 3,228,580 apparatus has no automatic material handling and is not self-contained. The Moehleopak apparatus U.S. Pat. No. 3,592,376 has no automatic material handling and is not self-contained. The Fry apparatus U.S. Pat. No. 3,711,007 does not place the studs automatically and is no self-contained and is operated manually. The Schultz apparatus U.S. Pat. No. 4,305,538 is not self-loading, and is not completely self-contained requiring electricity. Although the results of the Schultz apparatus is similar the method is completely different.

SUMMARY OF THE INVENTION

Among several objects of the invention are an automatic self-contained and portable method of fabricating and fastening together frames for construction of buildings such as walls, floors and ceiling panels having cross members, (e.g., studs with top and bottom plates).

In general, the apparatus comprises a carriage powered by an engine with hydraulic and pneumatic systems and several lumber compartments. As the carriage is driven on a pair of tracks the lumber is automatically placed between parallel plates on the track and nailed together as the apparatus moves forward leaving the completed wall on the track.

DETAILED DESCRIPTION OF THE PREFERRED EMBODIMENTS

Figure 1:
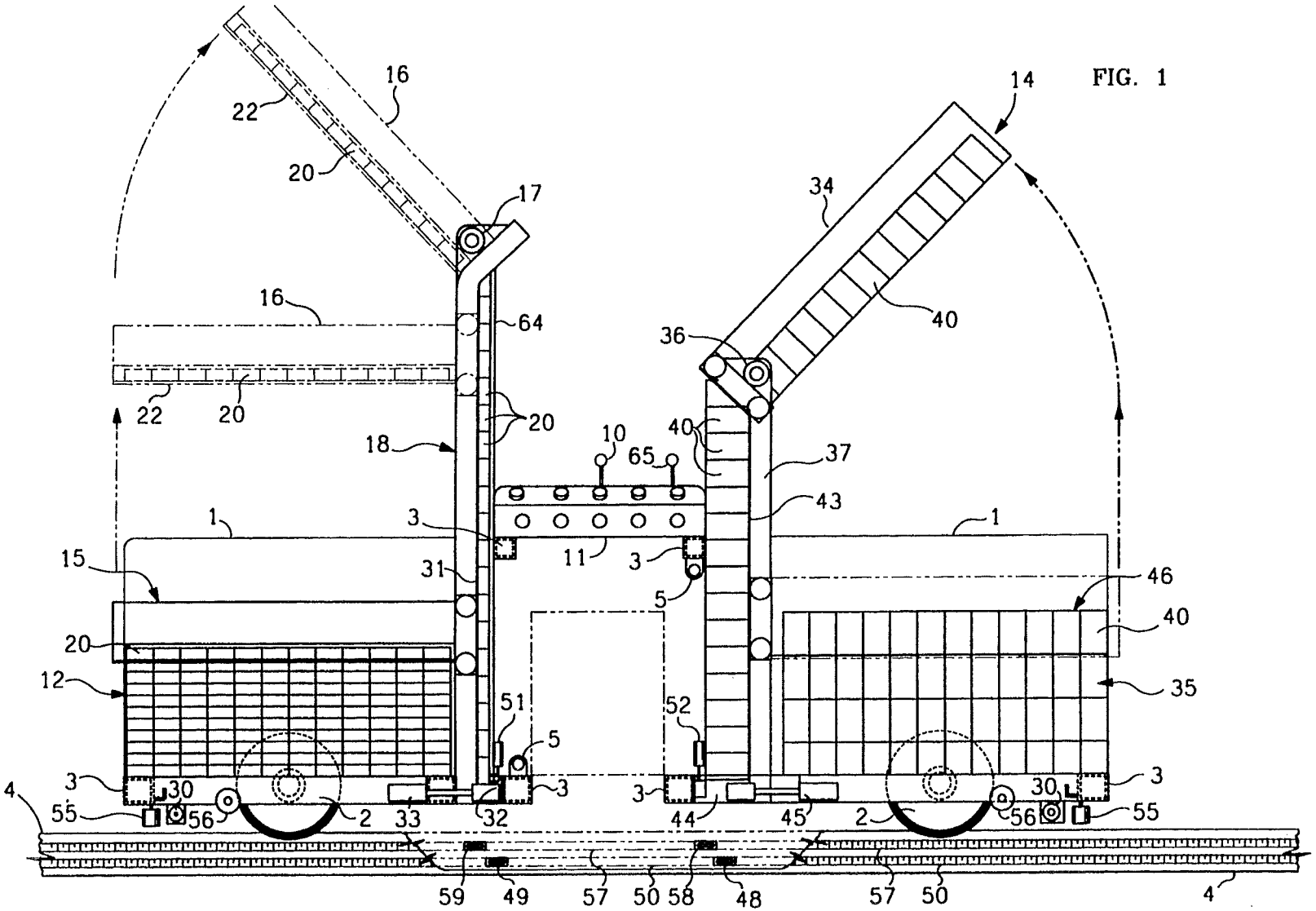
FIG. 1 is a top plan view of the carriage.
Figure 2:
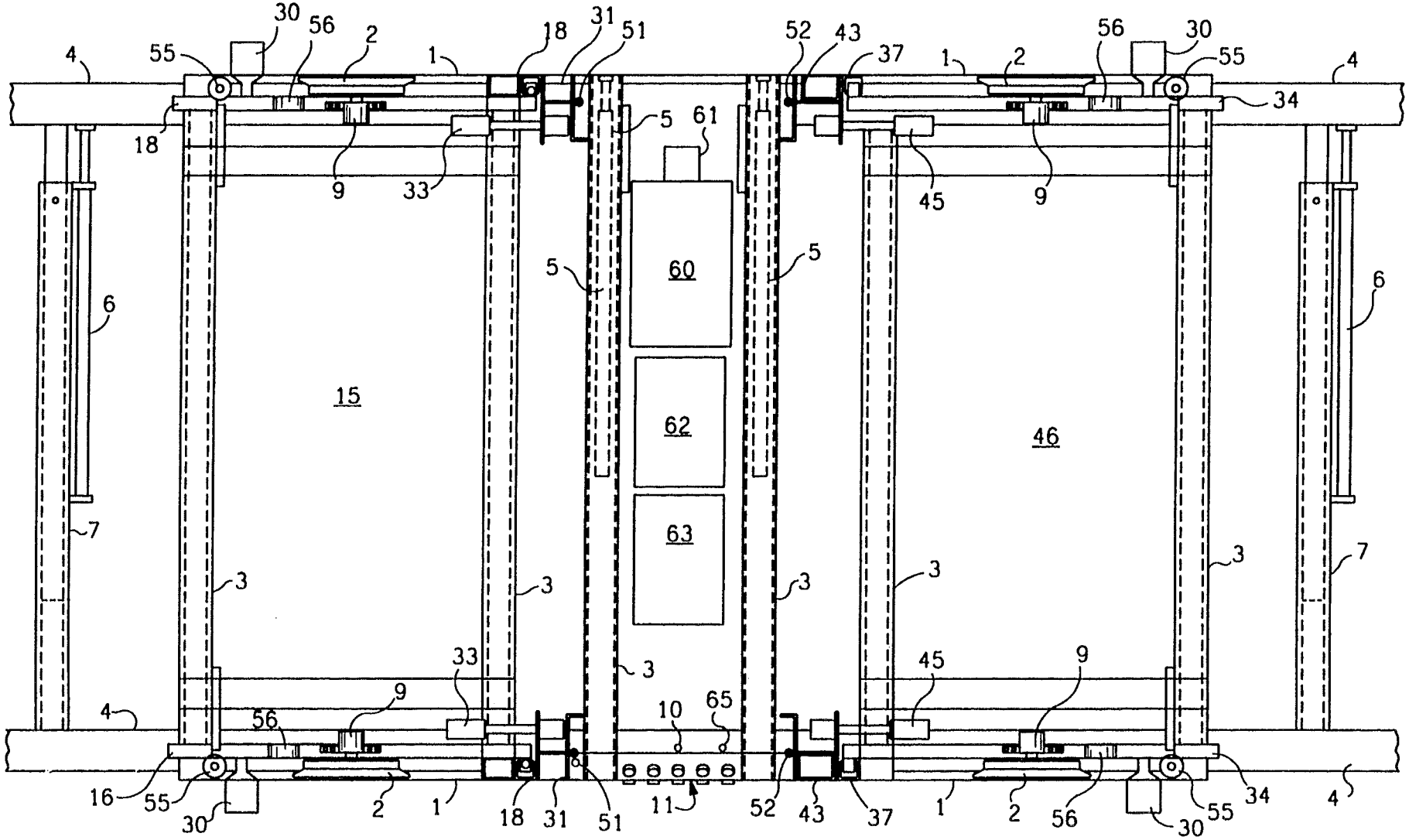
FIG. 2 is a side view of the carriage.

Referring to FIGS. 1 and 2, the carriage comprising plate sides 1 flanged wheels 2 telescoping cross frame 3 engine or motor 60 hydraulic pump 61 air compressor 62 hydraulic valves and tank 63 and control panel 11. The carriage is automatically adjustable to the length of the cross members to be fabricated by means of telescoping cross frame 3 hydraulic cylinders 5 and hydraulic valve 65 located on the control panel 11. The track 4 is adjustable by means of telescoping cross frame 7 and hydraulic cylinders 6.

Figure 12:
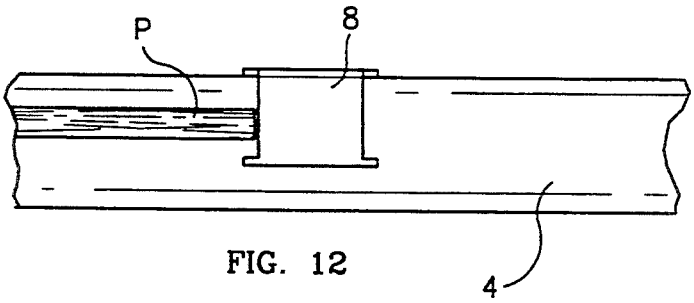
Figure 13:
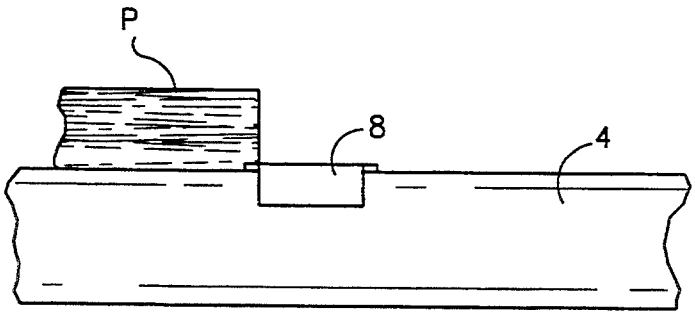
Figure 14:
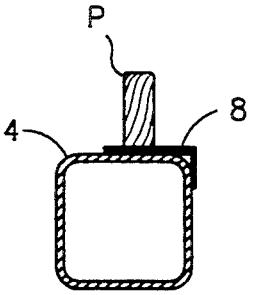

Referring to FIGS. 12–13–14, the parallel plates P are held in place by means of magnetized plate clips 8 place on the track Referring to FIGS. 1–2, the carriage is driven by hydraulic motors 9 connected to the flanged drive wheels 2 and controlled by the direction valve 10 located on the control panel 11. The carriage is driven to the end of the track 4.

Figure 10:
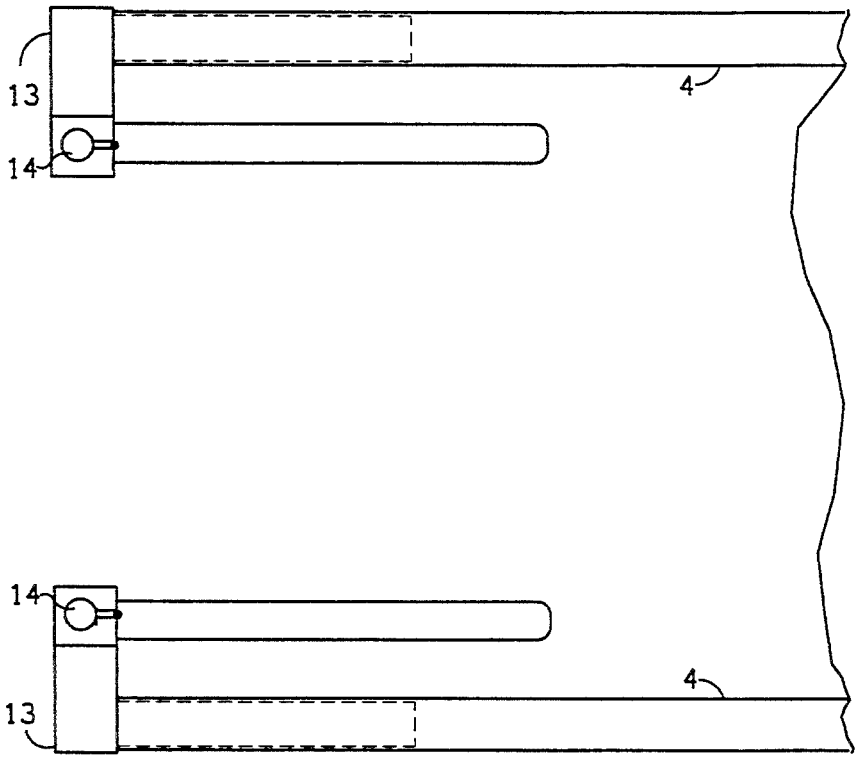
FIG. 10 shows details of the channel loader.
Figure 9:
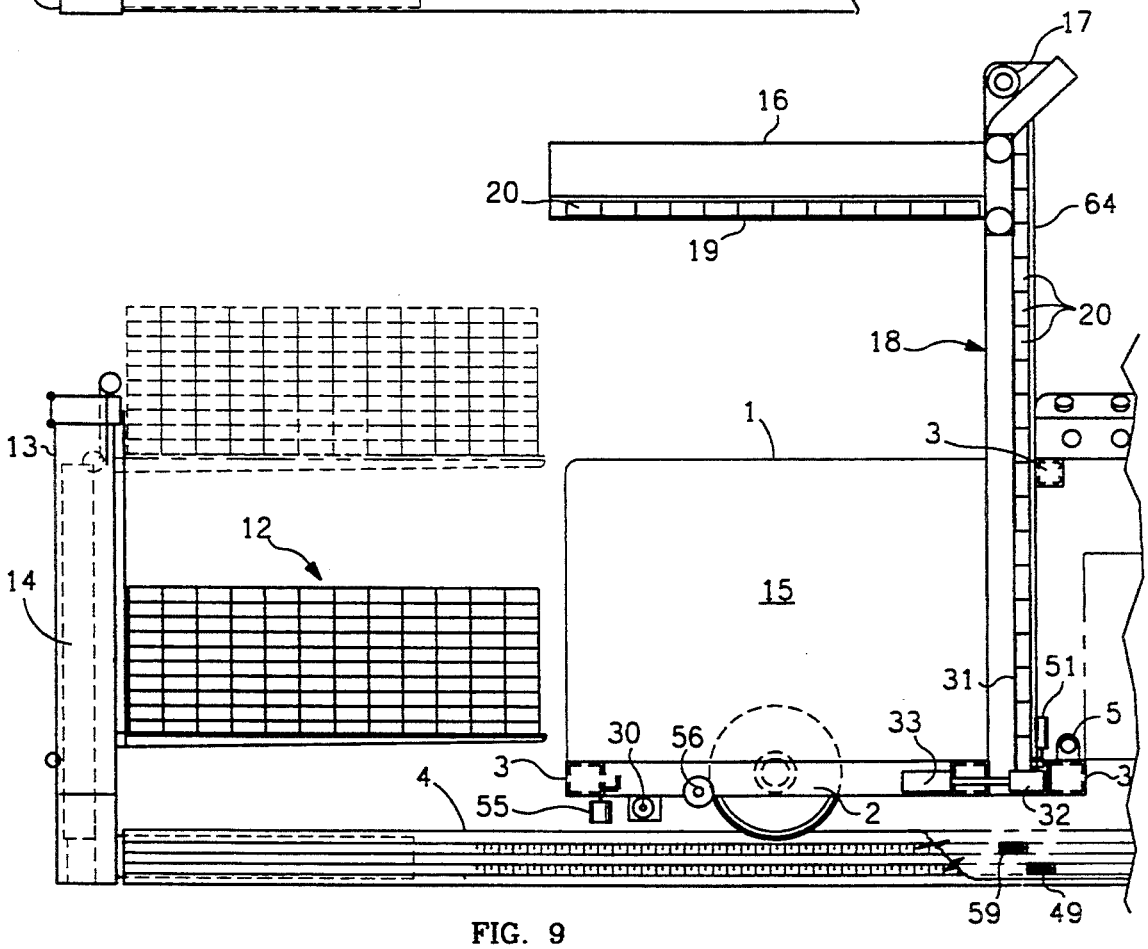
FIG. 9 shows details of the separator bar track.

Referring to FIGS. 9 and 10, the cross member rack 13 is lowered onto the carriage by means of hydraulic cylinders 14 located inside the cross member rack 13. The cross member stud package 12 is now in the cross member storage compartment 15 located inside the carriage.

Referring to FIG. 1, the stud cross member loader 16 is lowered onto the stud cross member package 12 by means of hydraulic motors 17 located on top of the stud cross member loader track 18.

Figure 3:
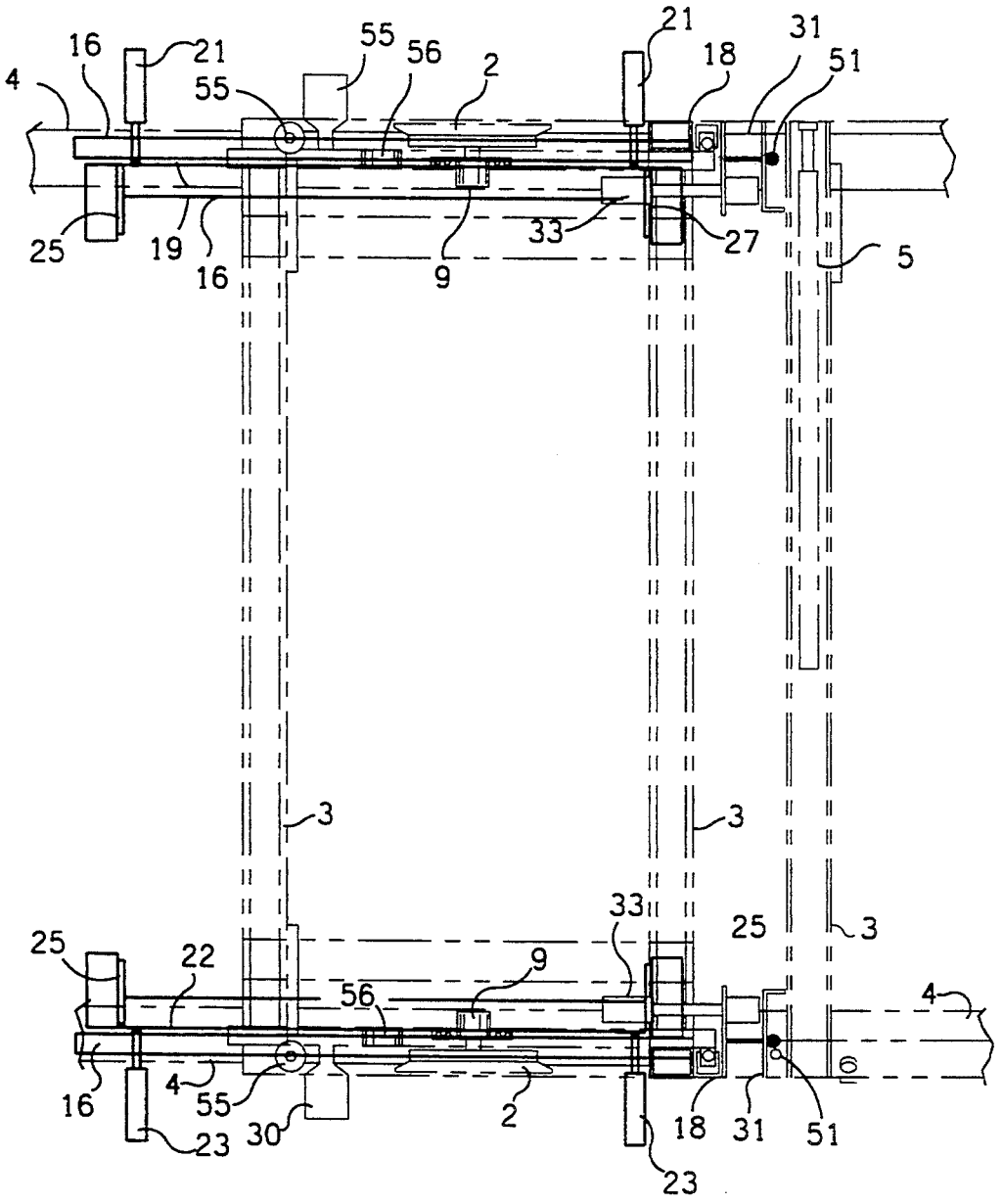
FIG. 3 is a top view of the stud loader.
Figures 8A, 8B, 8C, 8D, 8E, 8F:
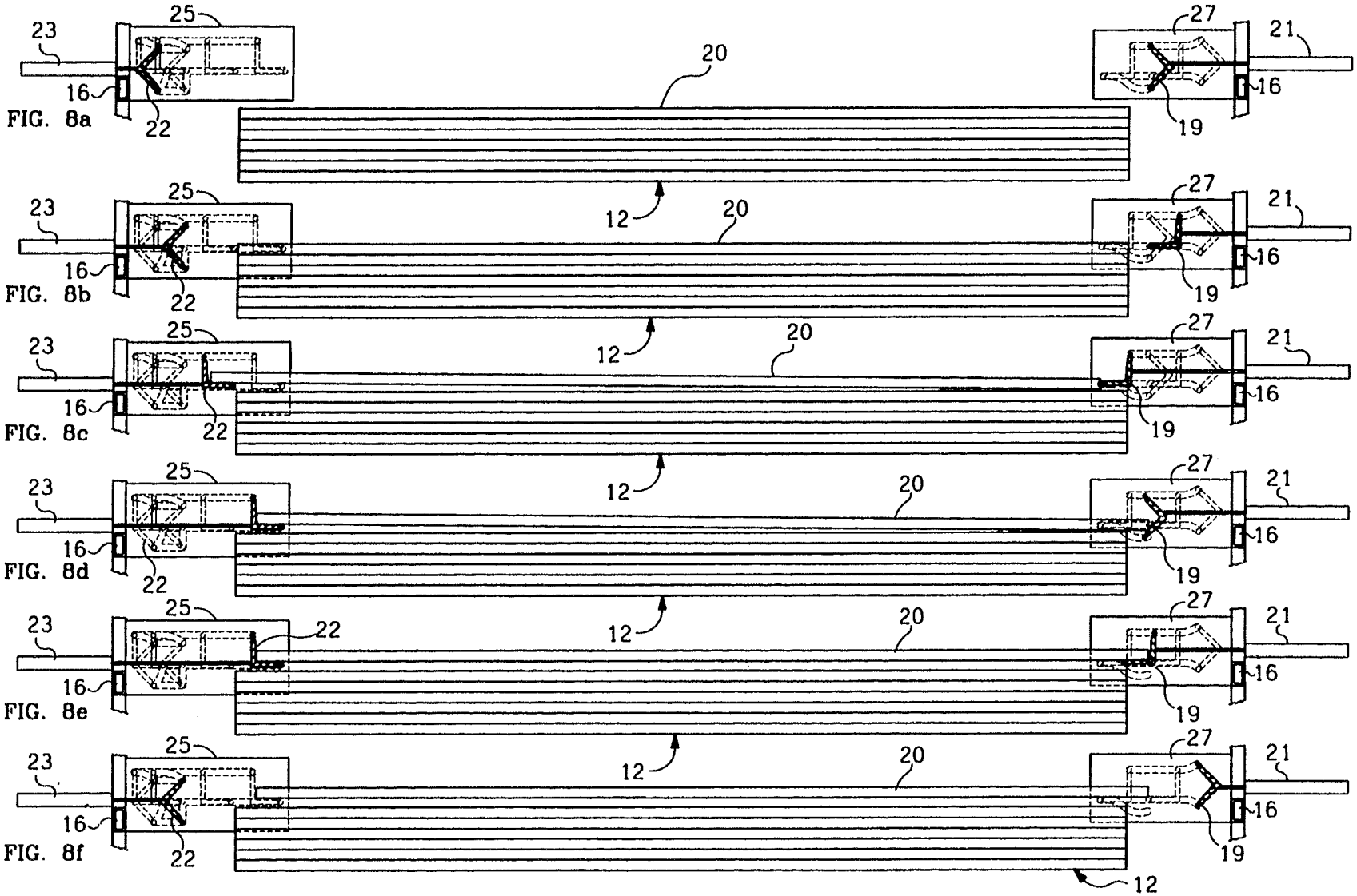
FIG. 8 shows details of the separator bar track.

Referring to FIGS. 1, 3, and 8, the stud separator bar 19 pushes the top layer of stud cross members 20 to one side by means of hydraulic cylinders 21 causing the top layer of stud cross members 20 on top of the stud separator bar 22. Stud separator bar 22 moves the top layer of stud cross members 20 in the opposite direction by means of hydraulic cylinders 23 causing the stud cross members 28 to move on top of stud separator bar 19. The top layer of stud cross members 20 are now inside the stud cross member loader 16.

Figure 5:
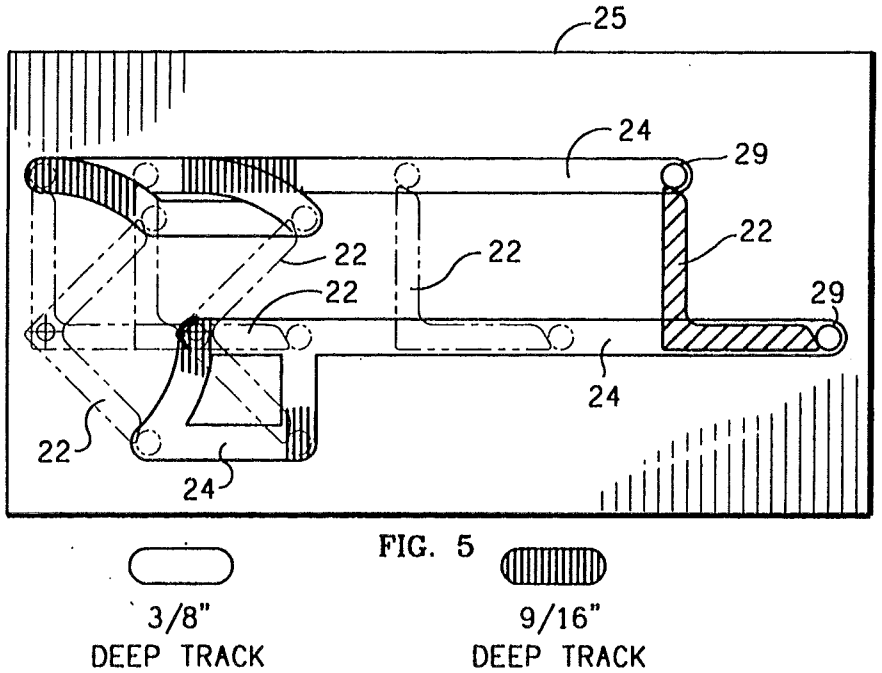
FIG. 5 is a top detail view of the cross member rack.

Referring to FIG. 5, showing the stud separator bar track 24 grooved into metal plates 25 located on each end of stud separator bar 22.

Figure 6:
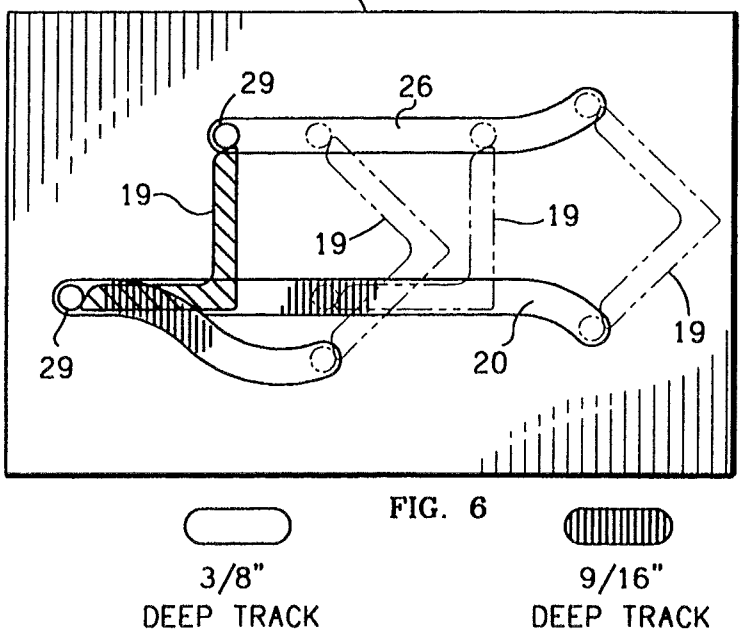
FIG. 6 is a side view of the cross member rack.

Referring to FIG. 6, showing the stud separator bar track 26 grooved into metal plates 27 located on each end of the stud separator bar 19 causing the stud separator bars 19 and 22 to move into precise positions during separation of the top layer of stud cross members 20 from stud cross member package 12.

Figure 7:
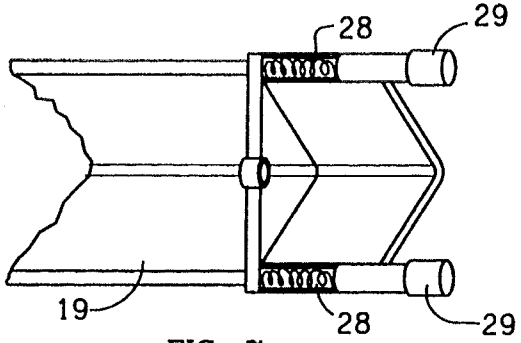
FIG. 7 shows details of the end separator bar track.

Referring to FIG. 7, showing end view of stud separator bars 19 and 22 with spring loaded roller cams 29. The spring 28 causing the roller cam 29 to follow the deepest part of the separator bar track 24 and 26 so as to perform different functions when traveling in opposite directions.

Referring to FIG. 8, showing different positions of separator bars 19 and 22 as the top layer of stud cross members 20 are removed from the stud cross member package 12.

Referring to FIGS. 1 and 2, the stud cross member loader 16 is raised by means of hydraulic motor 17 located on top of the stud cross member loader track 18. The stud cross members 20 are transferred from the stud cross member loader 16 to the stud cross member hopper 31 by means of gravity. The bottom cross member stud 32 is removed from the stud cross member hopper 31 by extending air cylinders 33 and clamping stud cross member 32 against the carriage.

The channel cross member loader 34 is lowered onto the channel cross member package 35 located in the channel cross member storage compartment 46 by means of hydraulic motors 36 located on top of the channel cross member loader track 37.

Figure 4:
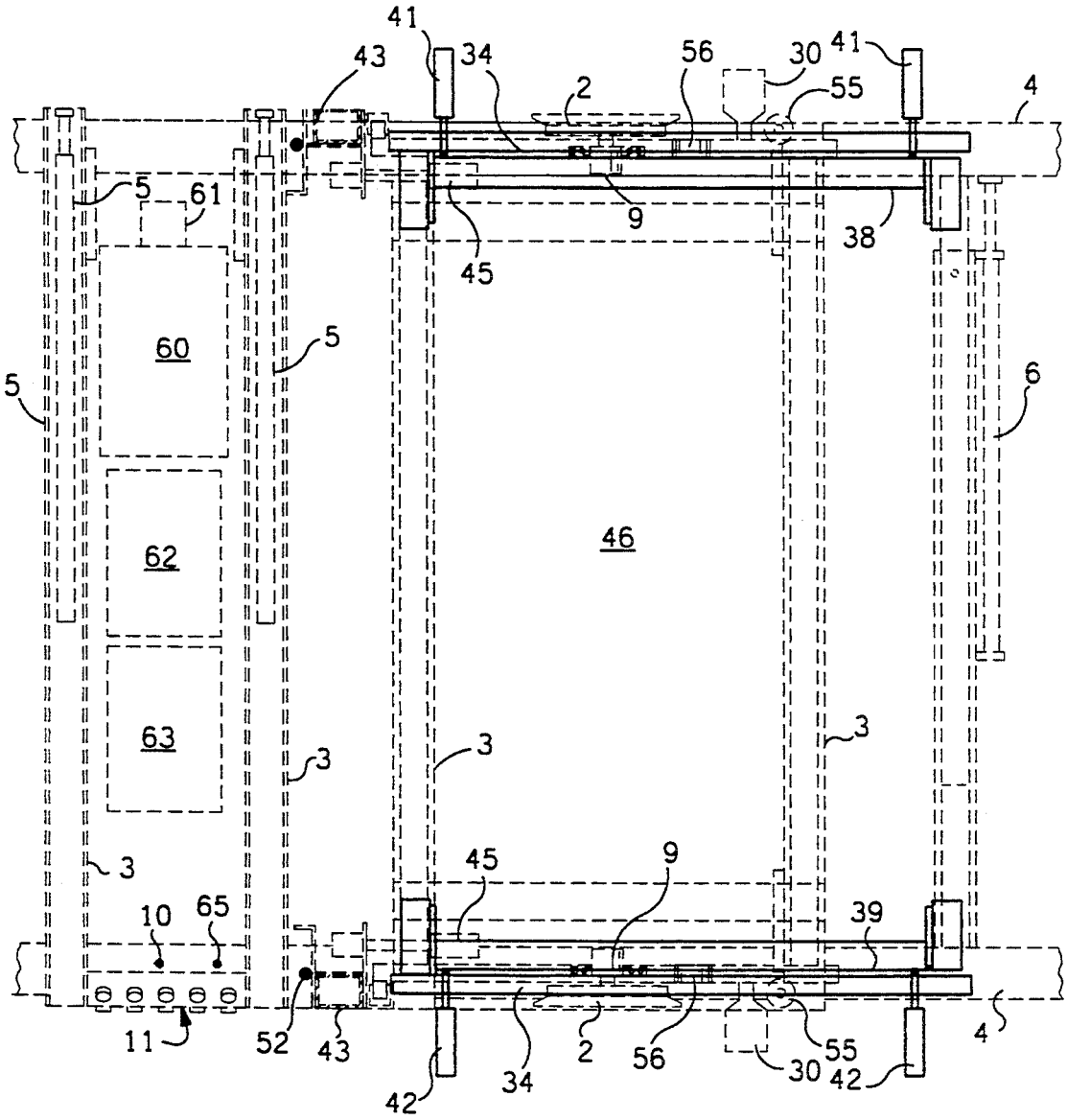
FIG. 4 shows details for leading cross member.

Referring to FIGS. 1 and 4, the separator bars 38 pushes the top layer of channel cross member 40 on top of the separator bar 39 by means of hydraulic cylinders 41 separator bar 39 pushes the channel cross member 40 on top of separator bar 38 by means of hydraulic cylinders 42.

Referring to FIG. 1, the top layer of channel cross members 40 are now inside the channel cross member loader 34, the channel cross member loader 34 is raised by means of hydraulic motors 36 located on top of the channel cross member loader track 37. The channel cross members 40 are transferred to the channel cross member hopper 43 by means of gravity. The bottom channel cross member 44 is removed from the channel cross member hopper 43 by extending air cylinders 45 and clamping channel cross member 44 against the carriage. The machine is now loaded with 2×4 stud cross members and 4×6 channel cross members and ready to fabricate walls.

Referring to FIGS. 1 and 2, the carriage is driven on the track 4 by operating the direction valve 10 located on the control panel 11. As the carriage moves forward the readers 48 and 49 are actuated by the program tape 50 located on the side of the track 4 causing the air cylinders 33 and 45 to retract releasing the channel cross member 44 or the stud cross member 32.

Figure 11:
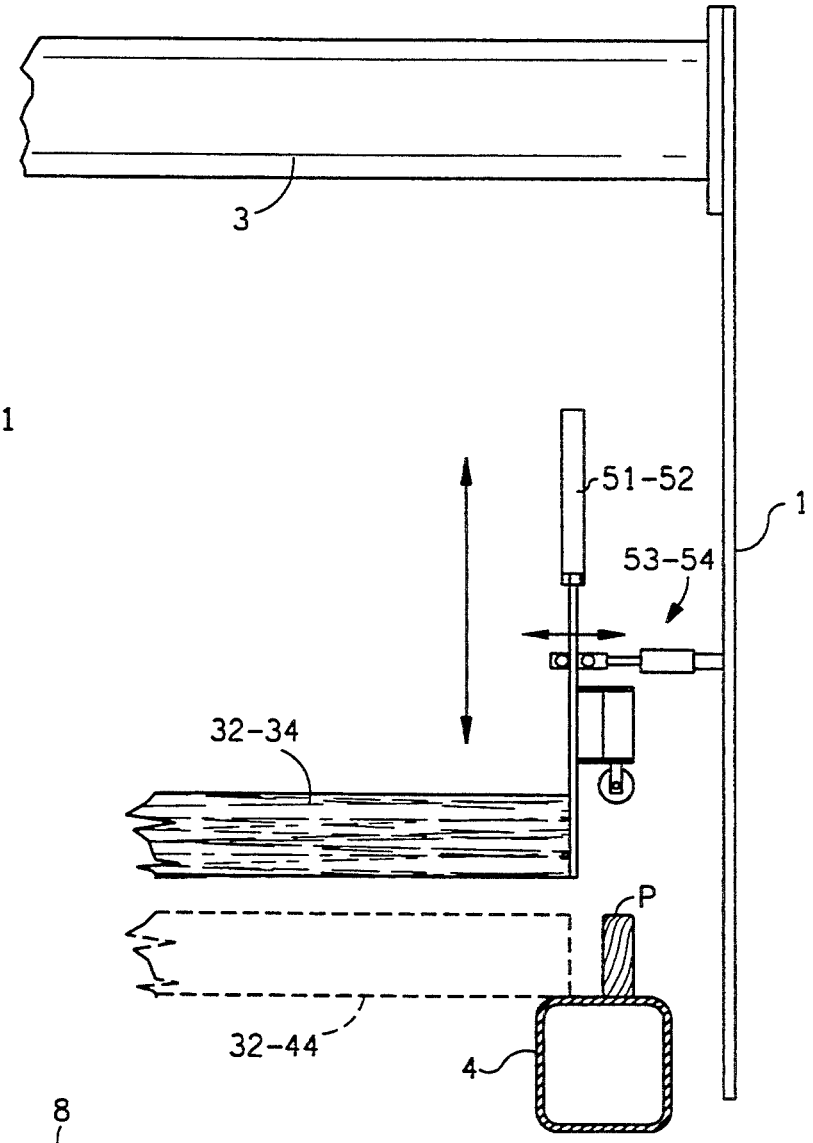
FIGS. 11–14 show the stud placement cylinders and clips.

Referring to FIG. 11, the stud placement cylinders 51 or the channel placement cylinders 52 is extended causing the stud cross member 32 or the channel cross member 44 to be lowered onto the track 4. Placement cylinders 53 or 54 retract causing the cross member to be released from the carriage between the parallel plates P and will repeat each time the readers 48 or 49 are actuated by the program tape 50 causing stud cross members 32 or channel cross members 44 to be placed on the track 4 in predetermined spacing by the program tape 50 as the carriage moves forward.

Referring to FIGS. 1 and 2, the carriage is driven in the opposite direction, readers 58 and 59 are actuated by program tape 57 located on the side of the track 4 causing the air cylinders 33 and 45 to retract releasing the channel cross member 44 or the stud cross member 32.

Referring to FIG. 11, the stud placement cylinders 51 or the channel placement cylinders 52 is extended causing the stud cross member 32 or the channel cross member 44 to be lowered onto the track 4. Placement cylinders 53 or 54 retract causing the cross member to be released from the carriage between the parallel plates P and will repeat each time the readers 58 and 59 are actuated by the program tape 57.

Referring to FIGS. 1 and 2, the program tape readers 48, 49, 58 and 59 are laser bar code readers readily available in the market. The program tapes 50 and 57 are the full length of the wall to be built and comprised of ½ inch banding material with bar code labels placed in precise spacing and attached to the track 4 with contact cement.

Referring to FIGS. 1 and 2, the cross members and the parallel plates P are compressed together by means of the compression rollers 55 and 56 located on each end of the carriage. The pneumatic nail guns 30 are actuated by sensors. Leaving the walls fastened together on the track 4 as the carriage moves forward and repeats the same when traveling in the opposite direction by means of a different program tape 57, and readers 58 and 59. The machine builds half the walls traveling forward and the other half of the walls traveling in reverse, completing all the walls for a building in one production run. For example, if 200 feet of walls were needed the machine can build 100 feet of walls traveling forward, and 100 ft of walls traveling in reverse requiring only half the track 4 and space needed if the machine only built walls traveling in one direction. When 3×4 studs are required on the first floor of a 3 story building the stud spacer bar 64 is removed from the stud cross member hopper 31 causing the stud cross member hopper 31 to be large enough to use 3×4 stud cross members.

I claim:

1. A self-contained, self-loading vehicle for fabricating frames for buildings having plural cross members and parallel plates comprising:

a carriage with flanged wheels thereunder so as to roll along;

a track to support said carriage with clips to hold said parallel plates in place;

an engine mounted on said carriage for producing energy;

a means for controllably coupling said energy to said flanged wheels;

a cross member rack placed at each end of said track with a frame to support packages of cross members with means to raise and lower said cross member packages into cross member storage compartments on said carriage;

a stud cross member storage compartment and a channel cross member storage compartment;

a channel cross member loader and a stud cross member loader with means to remove cross members from the stud and cross member storage compartments and place cross members into a stud cross member hopper and a channel cross member hopper;

a stud cross member hopper and a channel cross member hopper with means to remove stud cross members and channel cross members from a bottom of the hoppers;

a removable spacer bar in said stud cross member hopper to accommodate different size cross members when removed;

placement cylinders mounted at the bottom of the channel cross member hopper and the stud cross member hopper enabling the cross members to be placed onto the track as the carriage is moved in a forward or reverse direction;

a pneumatic system mounted on said carriage with means for clamping, placing, and fastening said cross members, wherein said means for fastening comprises a plurality of nail guns mounted on sides of the carriage and controlled by sensors;

a hydraulic system mounted on said carriage with means to remove said cross members from the stud and channel cross members storage compartments and hoppers;

an automated control system mounted on said carriage with tape readers for reading a plurality of program tapes, each program tape having a plurality of information thereon, each program tape attached to a side of the carriage track, said tape readers mounted on the carriage to actuate the air cylinders at the bottom of the stud cross member and channel cross member hoppers so as to place cross members in predetermined places on the track, and enable the vehicle to assemble all walls for a building in one production run; and the carriage having a telescoping cross frame so as to adjust to different lengths of cross members and automatically controlled at a control panel by means of hydraulic cylinders.

* * * * *